US012698920B2

(12) United States Patent
Edens et al.

(10) Patent No.: US 12,698,920 B2
(45) Date of Patent: Aug. 4, 2026

(54) ELECTRICAL RELAY SWITCH FOR A BLOWER OF A CLIMATE CONTROL SYSTEM

(71) Applicant: Trane International Inc., Davidson, NC (US)

(72) Inventors: John R. Edens, Troup, TX (US); Mark Hudgins, Whitehouse, TX (US); Daren Lee Epperson, Whitehouse, TX (US)

(73) Assignee: TRANE INTERNATIONAL INC., Davidson, NC (US)

( * ) Notice: Subject to any disclaimer, the term of this patent is extended or adjusted under 35 U.S.C. 154(b) by 226 days.

(21) Appl. No.: 18/748,445

(22) Filed: Jun. 20, 2024

(65) Prior Publication Data

US 2025/0389449 A1 Dec. 25, 2025

(51) Int. Cl.

| | |
|---|---|
| ***F24F 11/88*** | (2018.01) |
| ***F24F 11/48*** | (2018.01) |
| ***F24F 11/81*** | (2018.01) |
| ***F25B 49/00*** | (2006.01) |

(52) U.S. Cl.

CPC ..... *F24F 11/88* (2018.01); *F24F 11/48* (2018.01); *F24F 11/81* (2018.01); *F25B 49/00* (2013.01); *F25B 2700/173* (2013.01)

(58) Field of Classification Search

None

See application file for complete search history.

(56) References Cited

U.S. PATENT DOCUMENTS

| | | | | |
|---|---|---|---|---|
| 5,818,194 | A | 10/1998 | Nordby | |
| 8,493,008 | B2 | 7/2013 | Merkel et al. | |
| 9,201,433 | B2 | 12/2015 | Becerra et al. | |
| 9,657,960 | B2 | 5/2017 | Becerra et al. | |
| 10,309,405 | B2 | 6/2019 | Arensmeier et al. | |
| 10,533,768 | B2 | 1/2020 | Mowris et al. | |
| 10,605,495 | B1 | 3/2020 | Falls et al. | |
| 10,648,687 | B1 | 5/2020 | Zhang et al. | |
| 11,719,465 | B2 | 8/2023 | Huang et al. | |
| 2003/0030392 | A1* | 2/2003 | Neranjan | F24F 11/32 318/34 |
| 2007/0040040 | A1* | 2/2007 | Mueller | F24F 11/30 236/1 C |
| 2010/0236262 | A1* | 9/2010 | Lifson | F24F 3/1405 236/44 C |
| 2023/0065986 | A1 | 3/2023 | Broker et al. | |

* cited by examiner

*Primary Examiner* — Jerry-Daryl Fletcher

*Assistant Examiner* — Daniel C Comings

(74) *Attorney, Agent, or Firm* — Womble Bond Dickinson (US) LLP

(57) ABSTRACT

An embodiment of an indoor unit of a climate control system includes a blower to generate an airflow, a heat exchanger to transfer heat between a refrigerant and the airflow, and a motor to drive the blower. The motor includes first and second taps, the first tap to be electrically coupled to a first thermostat terminal. The motor configured such that: energizing the first tap and not the second tap operates the motor at a first blower speed; and energizing the first and second tap operates the motor at a second blower speed. The indoor unit also includes an electrical relay switch coupled to the second tap and configured to electrically couple to a second thermostat terminal such that energization of the second thermostat terminal is to actuate the switch from a first position to electrically de-energize the second tap to a second position to electrically energize the second tap.

20 Claims, 4 Drawing Sheets

ELECTRICAL RELAY SWITCH FOR A BLOWER OF A CLIMATE CONTROL SYSTEM

CROSS-REFERENCE TO RELATED APPLICATIONS

Not applicable.

BACKGROUND

A climate control system may operate to heat or cool an indoor space, which may include an interior space of a home, office, store, apartment, etc. For instance, some climate control systems may circulate a refrigerant between a pair of heat exchangers to transfer heat between the interior space and an ambient environment, which may include an outdoor environment. The climate control system may include a blower that is configured to generate an airflow to exchange heat with the refrigerant in one of the pair of heat exchangers.

BRIEF SUMMARY

Some embodiments disclosed herein are directed to an indoor unit of a climate control system. In some embodiments, the indoor unit includes a blower configured to generate an airflow. In addition, the indoor unit includes a heat exchanger that is configured to transfer heat between a refrigerant and the airflow. Further, the indoor unit includes a constant torque motor that is configured to drive the blower, the constant torque motor including a first tap and a second tap, the first tap being configured to be electrically coupled to a first terminal of a thermostat. The constant torque motor being configured such that energization of the first tap and not the second tap is associated with operating the constant torque motor at a first blower speed; and energization of the first tap and the second tap is associated with operating the constant torque motor at a second blower speed that is greater than the first blower speed. Still further, the indoor unit includes an electrical relay switch that is electrically coupled to the second tap, the electrical relay switch being configured to be electrically coupled to a second terminal of the thermostat such that energization of the second terminal is configured to actuate the electrical relay switch from (i) a first position to electrically de-energize the second tap to operate the constant torque motor at the first blower speed to (ii) a second position to electrically energize the second tap to operate the constant torque motor at the second blower speed.

Some embodiments disclosed herein are directed to a method of operating a climate control system including a blower that is driven by a constant torque motor to generate an airflow for an indoor space. In some embodiments, the method includes (a) energizing a first tap on the constant torque motor with a first terminal on a thermostat to operate the constant torque motor at a first blower speed. In addition, the method includes (b) energizing an electrical relay switch with a second terminal on the thermostat, during (a), to actuate the electrical relay switch from a first position to a second position to electrically energize a second tap on the constant torque motor and thereby operate the constant torque motor at a second blower speed that is greater than the first blower speed, the electrical relay switch comprising a single throw double pole relay.

Some embodiments disclosed herein are directed to a climate control system to condition an indoor space. In some embodiments, the climate control system includes a blower configured to generate an airflow for the indoor space and a constant torque motor that is configured to drive the blower. The constant torque motor includes a first tap and a second tap and configured such that: energization of the first tap and not the second tap is associated with operating the constant torque motor at a first blower speed; and energization of the first tap and the second tap is associated with operating the constant torque motor at a second blower speed that is greater than the first blower speed. In addition, the climate control system includes an evaporator that is configured to transfer heat from the airflow to a refrigerant, the evaporator operable at a first cooling stage to deliver a first cooling capacity to the airflow and a second cooling stage to deliver a second cooling capacity that is greater than the first cooling capacity. Further, the climate control system includes a thermostat including a first terminal and a second terminal, the first terminal being associated with operation of the evaporator in the first cooling stage and the second terminal being associated with operation of the evaporator in the second cooling stage, and the first terminal being electrically coupled to the first tap on the constant torque motor. Still further, the climate control system includes an electrical relay switch that is electrically coupled to the second terminal such that energization of the second terminal is configured to actuate the electrical relay switch from (i) a first position to electrically de-energize the second tap to operate the constant torque motor at the first blower speed to (ii) a second position to electrically energize the second tap to operate the constant torque motor at the second blower speed.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those having ordinary skill in the art upon reading the following detailed description, and by referring to the accompanying drawings. It should be appreciated that this disclosure may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various embodiments, reference will now be made to the accompanying drawings in which.

DETAILED DESCRIPTION

A climate control system may circulate a conditioned airflow through an interior space using a blower. Initially, climate control systems were configured to provide a conditioned airflow at a single speed; however, it has become desirable to provide multiple speeds (or flow rates) for the conditioned airflow. For instance, it may be desirable to provide different conditioned airflow speeds in order to facilitate different levels or stages or cooling or heating provided by the climate control system, to facilitate dehumidification of the interior space, or to promote greater operating efficiency of the climate control system. In order to achieve different conditioned air speeds, the blower may be driven by a motor that is configured to operate at a plurality of different operating speeds. However, conventional wiring and control schemes for selecting different operating speeds for the blower motor are complex, which thereby increases the costs and complexity of the climate control system. These complexities are further increased when the blower is also configured to operate at different speeds in concert with a supplemental heating unit of the climate control system.

Accordingly, embodiments disclosed herein include climate control systems that are configured to operate a blower at multiple speeds by use of simple wiring connections. For instance, embodiments of climate control systems described herein may include an electrical relay switch that may be used to selectively operate the blower at multiple speeds. In addition, in some embodiments, the electrical relay switch may be further coupled to a supplemental heating unit of the climate control system so that the blower may be operated in concert with the supplemental heating unit without additional switches or controllers. Therefore, through use of the embodiments disclosed herein, a climate control system may employ a multi-speed blower during both cooling and heating without also substantially increasing the costs and complexities thereof.

Figure 1:
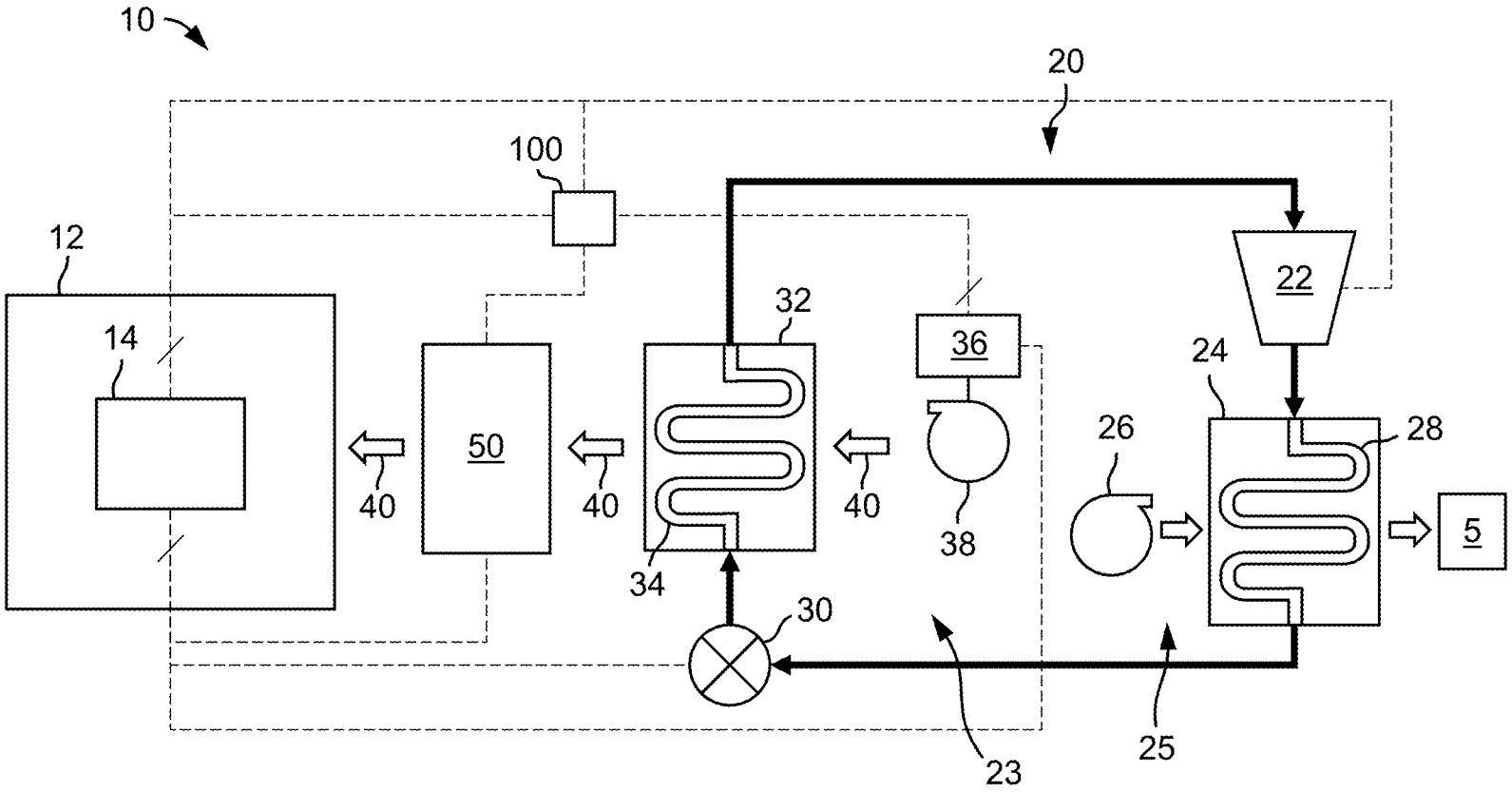
FIG. 1 is a schematic diagram of a climate control system including a multi-speed blower motor according to some embodiments disclosed herein.

Referring now to FIG. 1, a climate control system 10 according to some embodiments is shown. The climate control system 10 may be configured to condition an interior space 12 during operations. The interior space 2 may be the interior of a home, office, store, shipping container, refrigerator, freezer, or other interior space. Thus, the interior space 12 may be referred to herein as an "indoor space."

The climate control system 10 includes a refrigerant circuit 20 that is configured to circulate a refrigerant between a pair of heat exchangers 32, 24 to transfer heat between the interior space 12 and an ambient environment 5 during operations. The ambient environment 5 may comprise an environment that at least partially surrounds the interior space 12. For instance, in some embodiments, the ambient environment 5 comprises an outdoor environment that surrounds the housing, building, structure, or container that defines the interior space 12. Thus, the ambient environment 5 may be referred to herein as an "outdoor environment." In some embodiments, the refrigerant circuit 20 may be configured to transfer heat from the interior space 12 to the ambient environment 5 so as to cool the interior space 12. In some embodiments, the climate control system 10 may be configured as a heat pump that is configured to selectively reverse the flow direction of the refrigerant in the refrigerant circuit 20 to selectively heat the interior space 12 during operations.

Referring still to FIG. 1, the climate control system 10 generally includes a first heat exchanger 32, a compressor 22, a second heat exchanger 24, and an expansion device 30 that are all interconnected along the refrigerant circuit 20. When climate control system 10 is circulating the refrigerant in the refrigerant circuit 20 to cool the interior space 12, the compressor 22 may compress the refrigerant in a gaseous state and output a compressed gaseous refrigerant stream to the second heat exchanger 24. The refrigerant may flow through a coil 28 of the second heat exchanger 24 to facilitate heat transfer from the gaseous refrigerant to the ambient environment 5 and thereby condense the gaseous refrigerant stream to (or substantially to) the liquid phase. Specifically, a fan 26 may generate an airflow that flows over, through, and/or across coil 28 of the second heat exchanger 24 to pick up heat from the refrigerant and then carry the heat to the ambient environment 5. Thus, the second heat exchanger 24 may function as a "condenser" for the refrigerant when the refrigerant circuit 20 is circulating the refrigerant to cool the interior space 12.

The refrigerant may be discharged from the second heat exchanger 24 in (or substantially in) the liquid phase, and may then be expanded through an expansion device 30 to transform the substantially liquid refrigerant to a mixed phase refrigerant stream that is reduced in temperature. This mixed phase refrigerant may then be flowed through a coil 34 in the first heat exchanger 32 to facilitate heat transfer from an airflow 40 generated by a blower 38 to the mixed phase refrigerant so as to boil the refrigerant back to (or substantially to) a gaseous phase and thereby reduce the temperature of the airflow 40. Thus, the first heat exchanger 32 may function as an "evaporator" for the refrigerant when the refrigerant circuit 20 is circulating the refrigerant to cool the interior space 12.

The cooled airflow 40 may then progress into and through the interior space 12. The gaseous (or substantially gaseous) refrigerant is then flowed out of the first heat exchanger 32 and back to the compressor 22 to restart the process described above.

The refrigerant circuit 20 can be operated at a plurality of different cooling stages during operation to deliver different cooling capacities to the interior space 12. Specifically, the compressor 22 may be operated at a plurality of different speeds to change a flow rate of refrigerant through the refrigerant circuit 20. Generally speaking, as the flow rate of refrigerant increases, the temperature of the coil 34 in the first heat exchanger 32 decreases. As a result, an increase in the flow rate of the refrigerant through the refrigerant circuit 20 when cooling the interior space 12 may provide a greater cooling capacity to the interior space 12.

In addition, the blower 38 may be driven by a blower motor 36 (or more simply "motor 36") at a plurality of different blower speeds so as to change a flow rate of the airflow 40 during operations. Without being limited to this or any other theory, changing the flow rate of the airflow 40 may allow for more efficient heat transfer between the refrigerant flowing in the coil 34 and the airflow 40 during operations. In some embodiments, the flow rate of the airflow 40 may be generally increased along with the flow rate of the refrigerant through the refrigerant circuit 20 to provide a greater volume of the cooled airflow 40 to the interior space per unit time. Thus, in some embodiments, the speed of the motor 36 may be increased as the speed of the compressor 22 is increased to operate that the plurality of different cooling stages.

As previously described, in some embodiments, the climate control system 10 may be configured as a heat pump to selectively heat the interior space 12 via circulation of refrigerant along the refrigerant circuit 20. Specifically, the flow direction of the refrigerant in the refrigerant circuit 20 may be reversed from that shown in FIG. 1 (e.g., via a suitable reversing valve that is not shown in FIG. 1) so that the first heat exchanger 32 condenses the refrigerant and the second heat exchanger 24 boils the refrigerant. As a result, reversing the flow direction of the refrigerant circuit 20 from that shown in FIG. 1 is configured to transfer heat from the ambient environment 5 to the interior space 12.

Moreover, as is similarly described herein for the cooling mode operation, the refrigerant circuit 20 can be operated at a plurality of different heating stages that may be associated with different operating speeds of the compressor 22. Thus, in the same way that increasing a speed of the compressor 22 during the cooling mode operations may increase a cooling capacity that may be delivered to the interior space, increasing a speed of the compressor 22 during a heating mode operation may be configured to deliver an increased heating capacity to the interior space 12 during operations.

Referring still to FIG. 1, the climate control system 10 may also include a supplemental heating unit 50 that is configured to heat the airflow 40 so as to heat the interior space 12. For instance, the supplemental heating unit 50 may be configured to generate heat separate from the refrigerant circuit 20. As a result, the supplemental heating unit 50 may be used in some embodiments of climate control system 10 that are not configured as a heat pump as previously described. However, it should be appreciated that the supplemental heating unit 50 may also be included in embodiments of climate control system 10 that are configured as a heat pump so as to provide additional heating capacity thereto.

In some embodiments, the supplemental heating unit 50 may comprise an electrically resistive heating unit that is configured to generate heat by energizing one or more resistive coils with electric current. In some embodiments, the supplemental heating unit 50 may be configured to generate heat by combusting natural gas or another combustible fuel. The supplemental heating unit 50 may be configured to operate at a plurality of different heating stages so as to deliver different heating capacities to the airflow 40. For instance, when the supplemental heating unit 50 comprises an electrically resistive heating unit, the one or more resistive coils of the supplemental heating unit 50 may be energized with greater levels or amounts of electrical current to increase in temperature and thereby operate at higher heating stages.

The climate control system 10 may include a thermostat 14 or other suitable controller that may be positioned in the interior space 12 or at any other suitable location. As will be described in more detail herein, the thermostat 14 may be electrically coupled to various other components of the climate control system 10, such as the supplemental heating unit 50, motor 36 of blower 38, compressor 22, expansion device 30, etc. The thermostat 14 may output one or more electrical signals that are configured to control the operation of the climate control system 10. For instance, the thermostat 14 may be configured to initiate start up or shut down of the refrigerant circuit 20 and the supplemental heating unit 50. In addition, thermostat 14 may adjust the operation of the refrigeration circuit 20, the supplemental heating unit 50, and the motor 36 of the blower 38 to operate the refrigerant circuit 20 and the supplemental heating unit 50 in the plurality of cooling stages and the plurality of heating stages during operations.

An electrical relay switch 100 may be coupled to the thermostat 14 and the motor 36 of the blower that is configured to selectively adjust an electrical input to the motor 36 so as to change the operating speed of the motor 36 and blower 38 during operations. For instance, as will be described in more detail below, the electrical relay switch 100 is configured to energize different combinations of taps on the motor 36 to adjust an operating speed of the motor 36 based on the cooling stage or heating stage of the climate control system 10. In addition, as will also be described in more detail herein, the electrical relay switch 100 may be configured to ensure a minimum speed of the blower 38 during an operation of the supplemental heating unit 50 so as to avoid damage to the supplemental heating unit 50 or a component thereof or coupled thereto.

In some embodiments, the first heat exchanger 32, expansion device 30, blower 38, motor 36, and supplemental heating unit 50 may be embodied as an at least partially integrated first unit 23. In some embodiments, the first unit 23 may be positioned in any suitable indoor space that may or may not be the same (or connected to) the indoor space 12. For instance, the first unit 23 may be positioned in an attic, storage room, basement, building, enclosure, that is proximate to, connected to, or at least partially integrated (or inside of) the indoor space 12. Thus, the first unit 23 may be referred to herein as an "indoor unit."

In addition, in some embodiments, the compressor 22, second heat exchanger 24, and fan 26 may be embodied as an at least partially integrated second unit 25. The second unit 25 may be positioned in the ambient environment 5, which (as previously described) may be outdoors. Thus, the second unit 25 may be referred to herein as an "outdoor unit."

However, these example positions of units 23, 25 are not intended to limit a particular location of either of the units 23, 25 in various embodiments. For example, in some embodiments, the indoor unit 23 and the outdoor unit 25 may be at least partially integrated with one another and co-located in an outdoor environment (e.g., such as in the case of a so-called "packaged unit" climate control system).

The electrical relay switch 100 may be included in one of the units 23, 25. For instance, in some embodiments, the electrical relay switch 100 may be at least partially included in the indoor unit 23 so as to be in relatively close proximity to the motor 36 and blower 38. However, other positions of the electrical relay switch 100 are contemplated herein.

Figure 2:
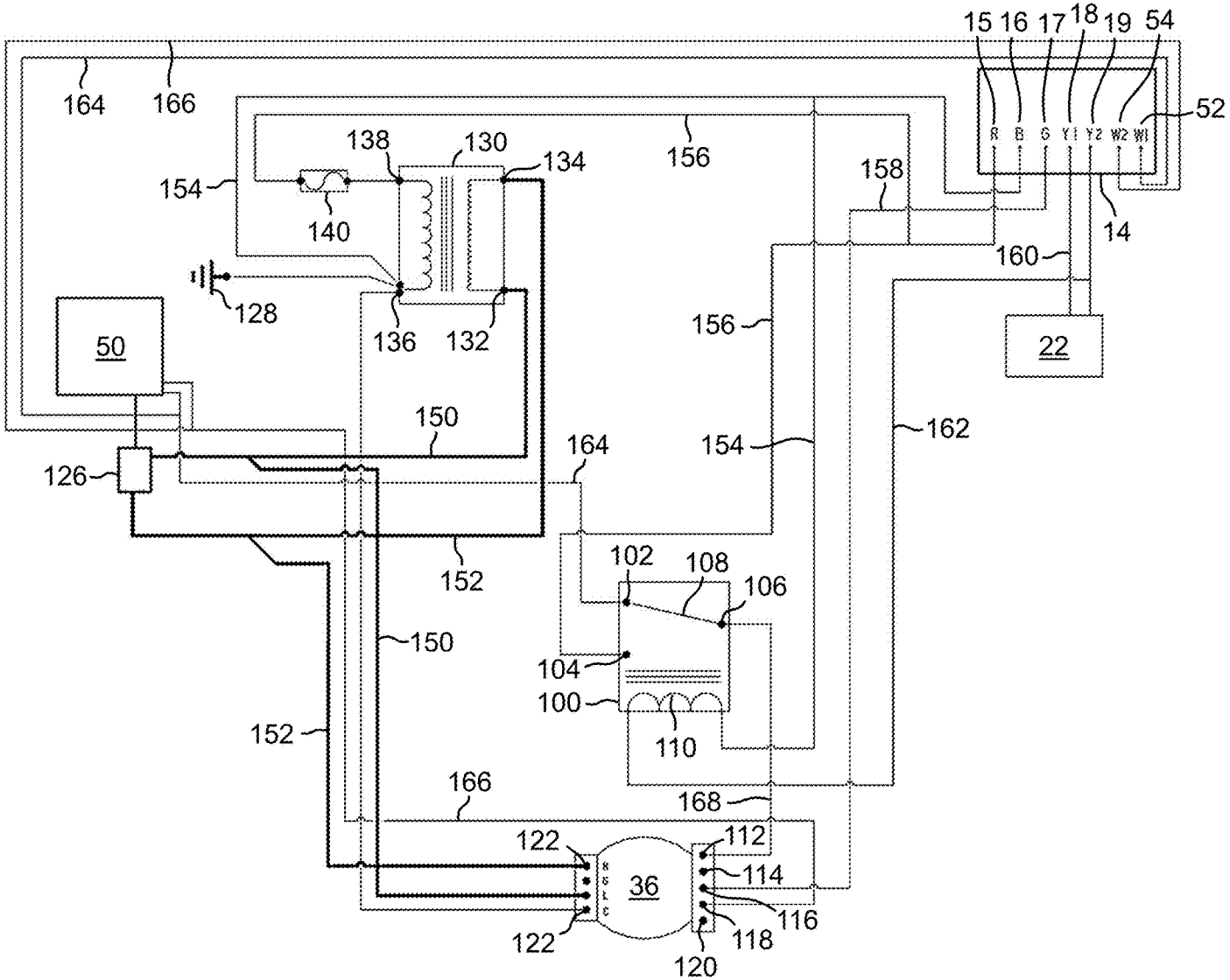
FIG. 2 is a wiring diagram showing an electrical relay switch in a first position for electrically connecting the muti-speed blower motor to other components of the climate control system of FIG. 1 according to some embodiments disclosed herein.
Figure 3:
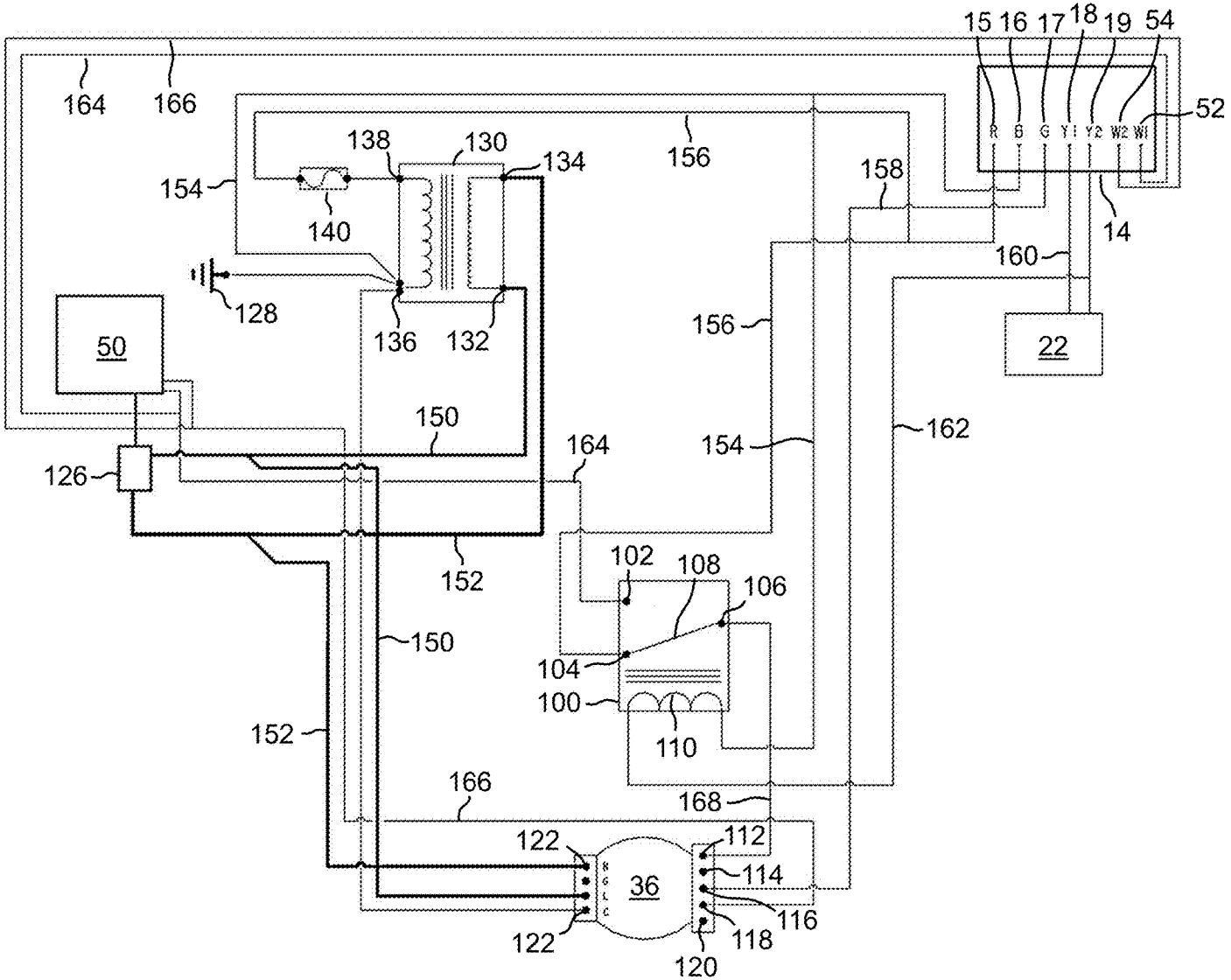
FIG. 3 is the wiring diagram of FIG. 2, showing the electrical relay switch in a second position according to some embodiments disclosed herein.

FIGS. 2 and 3 show more detailed wiring diagrams for the climate control system 10 of FIG. 1 is shown according to some embodiments. In particular, FIGS. 2 and 3 illustrate the electrical relay switch 100 in a first position (FIG. 2) and a second position (FIG. 3) for selectively operating the motor 36 at a plurality of different speeds during operations. When describing the features shown in the wiring diagrams of FIGS. 2 and 3, continuing reference will be made to the features of climate control system shown in FIG. 1.

The motor 36 may comprise a constant torque motor. Specifically, the motor 36 may comprise a constant torque electronically commutated motor that is configured to maintain a desired output torque during operation. In addition, the motor 36 may be configured to operate at a plurality of different speeds.

As shown in FIGS. 2 and 3, the motor 36 may have a plurality of power taps 122 that are configured to receive electrical power for powering motor 36 from an electrical power source 126. Also, the motor 36 may have a plurality of control taps 112, 114, 116, 118, 120 that may be selectively energized in order to cause the motor 36 to operate at a plurality of different speeds. Specifically, the motor 36 may include onboard electronics (not shown) that are configured to adjust an operating speed of the motor 36 based on the energization of one or more of the control taps 112, 114, 116, 118, 120.

The control taps 112, 114, 116, 118, 120, 122 may comprise conductive pads, terminals, plugs, wires, or any other suitable conductive structure that is configured to engage with and conduct an electrical signal from a wire or other conductive member. As described in more detail herein, the taps 112, 114, 116, 118, 120, 122 may be electrically coupled to selected wires (e.g., directly, via a suitable plug, terminal, etc.) that are electrically coupled to other components of the climate control system 10. The taps 112, 114, 116, 118, 120, 122 may conduct electrical current from the coupled wires to corresponding electronics within the motor 36 to power operation of (e.g., in the case of taps 122) or the control an operating speed of (e.g., in the case of taps 112, 114, 116, 118) motor 36 during operations.

In some embodiments, the motor 36 may operate at different speeds depending on which one or combination of the control taps 112, 114, 116, 118, 120 is energized. Thus, while the motor 36 may have a total of five (5) control taps 112, 114, 116, 118, 120 in the embodiment illustrated in FIGS. 2 and 3, the total number of operational speeds of the motor 36 may be greater than the total number of control taps 112, 114, 116, 118, 120 (or in this case, greater than five). Specifically, in some embodiments, the motor 36 may be operated at a total of nine (9) unique speeds-five (5) speeds being achieved by energizing each of the control taps 112, 114, 116, 118, 120 on its own, and an additional four (4) speeds being achieved by energizing one tap 112 in combination with one of the other control taps 114, 116, 118, 120. However, other numbers of speeds and combinations of the control taps 112, 114, 116, 118, 120 to achieve the different speeds are contemplated herein.

The electrical power source 126 may comprise a bus bar or other electrical member or assembly that is electrically coupled to a local power grid. The electrical power source 126 may provide line or grid power at 110 Volts of alternating current (VAC) or 220 VAC during operations. Many of the other electrical connections in the climate control system 10 may be at a lower voltage than that provided from the electrical power source 126 (such as at 24 VAC in some embodiments). Specifically, control signals, such as those received at the control taps 112, 114, 116, 118, 120 of motor 36 may be at a lower voltage than the line power provided from electrical power source 126. Thus, a transformer 130 is electrically coupled to the electrical power source 126 that is configured to step down the voltage provided therefrom prior to conducting it to the other components of the climate control system. The transformer 130 may include a pair of input terminals 132, 134 that are electrically coupled to hot wire 150 and common wire 152, respectively, that are electrically coupled to the electrical power source 126. The higher voltage electrical current provided by electrical power source 126 via wires 150, 152 may be stepped down to a desired voltage (such as 24 VAC as previously described) that is conducted out of a pair of output terminals 138, 136.

Specifically, one or more hot wires 156 may receive a stepped down supply voltage from the transformer 130 that is configured to supply electrical power to other components of the climate control system 10 as described herein. A fuse 140 may be coupled to the one or more hot wires 156 to limit an amount of electrical current that may be conducted via the one or more hot wires 156. In addition, one or more common wires 154 may be coupled to the output terminal 136 of transformer and may define (or be coupled to) a common ground 128 for various components of the climate control system 10.

One or more of the power taps 122 may be electrically coupled to the electrical power source 126 so that the one or more power taps 122 via the wires 150, 152. Thus, the motor 36 may be powered with the higher voltage current (e.g., 110 VAC, 220 VAC, etc.) provided from the electrical power source 126 during operations. In addition, the supplemental heating unit 50 may also be electrically powered by higher voltage current provided by the electrical power source 126 (note: a single wire is shown connecting the supplemental heating unit 50 and the electrical power source 126 for simplicity, but additional wires may be used to electrically coupled these components in at least some embodiments).

As previously described, the supplemental heating unit 50 may be configured to generate heat that is transferred to the airflow 40 separate and independent of the refrigerant circuit 20 (FIG. 1). As is also previously described, the supplemental heating unit 50 may comprise an electrically resistive heating unit or a furnace that is configured to combust a fuel. In the specific embodiment illustrated in FIGS. 2 and 3, the supplemental heating unit 50 comprises an electrically resistive heating unit that energizes an electrically resistive coil via the electrical current received from the electrical power source 126 to heat the airflow 40 during operations.

The supplemental heating unit 50 may be operable at a plurality of heating stages—such as a first or low heating stage and a second or high heating stage. In the low heating stage, the supplemental heating unit 50 may be configured to provide a first or low heating capacity to the airflow 40 (FIG. 1) and in the high heating stage, the supplemental heating unit 50 may be configured to provide a second or high heating capacity to the airflow 40 (FIG. 1) that is greater than the low heating capacity.

The thermostat 14 may include a plurality of terminals 15, 16, 17, 18, 19, 52, 54 for receiving and outputting electrical signals during operations. The terminals 15, 16, 17, 18, 19, 52, 54 may comprise a portion of the terminals that are included on the thermostat 14 in some embodiments. Thus, it should be appreciated that thermostat 14 may have additional terminals to those specifically described herein and shown in FIGS. 2 and 3. Also, in some embodiments, the thermostat 14 may include a subset of the terminals 15, 16, 17, 18, 19, 52, 54 shown in FIGS. 2 and 3. The terminals 15, 16, 17, 18, 19, 52, 54 may comprise any suitable electrically conductive tap, pad, wire, plug, or other conductive connector that may be connected to a wire, connector, etc. to conduct electrical signals to and from the thermostat 14 during operations.

The hot wire(s) 156 and common wire(s) 154 may be electrically coupled to a power input terminal 15 and common terminal 16, respectively, on the thermostat 14. The power input terminal 15 may receive and conduct electrical power throughout the thermostat 14, and may be used to selectively energize the other terminals 16, 17, 18, 19, 52, 54 as described in more detail herein. The common terminal 16 may be electrically coupled to the electrical ground 128. The power input terminal 15 and common terminal 16 of thermostat may be labeled "R" and "B," respectively, and the hot wire(s) 156 and common wire(s) 154 may be similarly colored red and black, respectively, so that they are easily identifiable (however, other color and label conventions are contemplated herein).

In addition to the power input terminal 15 and common terminal 16, the thermostat 14 may include a blower call terminal 17, a pair of cooling stage terminals 18, 19, and pair of heating stage terminals 52, 54. The blower call terminal 17 may be associated with a call from the thermostat 14 to operate the motor 36 of blower 38 to generate the airflow 40 (FIG. 1). Thus, the thermostat 14 may energize the blower call terminal 17 (via electrical current received by the thermostat at power input terminal 15) when operating the climate control system 10 (either by operating the refrigerant circuit 20 to cool or heat the indoor space 12 or operating the supplemental heating unit 50 to heat the interior space 12 as previously described and shown in FIG. 1). A wire 158 may be electrically coupled to the blower call terminal 17 and may also be electrically coupled to a first control terminal 116 on the motor 36. Thus, when the thermostat 14 energizes the blower call terminal 17, the electrical current is conducted via the wire 158 to energize the first control terminal 116 on motor 36.

The compressor stage terminals 18 and 19 may be associated with calls from the thermostat 14 to operate the compressor 22 at a plurality of different operational speeds to correspond with a pair of cooling stages of the refrigeration circuit 20 as previously described (FIG. 1). Specifically, the first compressor stage terminal 18 may be associated with operating the compressor 22 at a first or low speed to correspond with a first or low cooling stage of the refrigerant circuit 20 for delivering a first or low cooling capacity to the interior space 12 (FIG. 1), and the second compressor stage terminal 19 may be associated with operating the compressor 22 at a second or high speed to correspond with a second or high cooling stage of the refrigerant circuit 20 for delivering a second or high cooling capacity to the interior space 12 (FIG. 1). Wires 160, 162 may be electrically coupled to the cooling stage terminals 18, 19, respectively, and may also be electrically coupled to compressor 22 (or other component or terminal of the outdoor unit 25).

Similarly, the heating stage terminals 52 and 54 may be associated with calls from the thermostat 14 to operate the supplemental heating unit 50 at the low heating stage and the high heating stage, respectively. Wires 164, 166 may be electrically coupled to the heating stage terminals 52, 54, respectively, and may also be electrically coupled to supplemental heating unit 50, so that during operations, the thermostat 14 may cause the supplemental heating unit 50 to operate in the low heating stage and the high heating stage by energizing the terminals 52, 54 and wires 164, 166, respectively. Specifically, the thermostat 14 may cause the supplemental heating unit 50 to operate in the low heating stage by energizing a first heating stage terminal 52 and the wire 164, and the thermostat 14 may cause the supplemental heating unit 50 to operate at the high heating stage by energizing both the first heating stage terminal 52 and the second heating stage terminal 54 via wires 164, 166, respectively.

The blower call terminal 17 may be labeled "G" and the wire 158 coupled to the blower call terminal 17 may be colored green. In addition, the compressor stage terminals 18 and 19 may be labeled "Y1" and "Y2", respectively, and the wires 160, 162 may be colored yellow. Further, the heating stage terminals 52 and 54 may be labeled "W1" and "W2", respectively, and the wires 164, 166 maybe colored white. However, as was previously described for the other terminals 15 and 16, other colors and label conventions are contemplated herein.

The electrical relay switch 100 may comprise a single pole double throw (SPDT) relay switch that includes a pair of input terminals 102, 104 and a single output terminal 106. A switching element 108 may be actuated to place the electrical relay switch 100 in a first position (FIG. 2) to electrically couple a first input terminal 102 to the output terminal 106 and to electrically de-couple the second input terminal 104 from the output terminal 106. In addition, the switching element 108 may be actuated to place the electrical relay switch 100 in a second position (FIG. 2) to electrically couple the second input terminal 104 to the output terminal 106 and to electrically de-couple the first input terminal 102 from the output terminal 106.

The electrical relay switch 100 may also include an electromagnet 110 that is configured to selectively actuate the electrical relay switch 100 between the first position (FIG. 2) and the second position (FIG. 3). Specifically, the electromagnet 110 may be electrically coupled to the common wire(s) 154 and to the second compressor stage terminal 19 via wire 162. Thus, when the thermostat 14 electrically energizes the second cooling stage terminal 19, the electromagnet 110 is energized via wire 162 and induces a magnetic field within the electrical relay switch 100. Conversely, when the thermostat 14 electrically de-energizes the second cooling stage terminal 19, the electromagnet 110 is de-energized to remove the magnetic field from within the electrical relay switch 100. When the electromagnet 110 is energized, the generated magnetic field may actuate the switching element 108 to place the electrical relay switch 100 in the second position (FIG. 3). Conversely, when the electromagnet 110 is de-energized, the magnetic field is removed to actuate the switching element 108 to place the electrical relay switch 100 in the first position (FIG. 2).

The first input terminal 102 of electrical relay switch 100 may be electrically coupled to the first heating stage terminal 52 of the thermostat 14 via a wire 164. The second input terminal 104 may be electrically coupled to the hot wire(s) 156 that are continuously energized with the stepped down electrical current from the electrical power source 126 via transformer 130 as previously described. The output terminal 106 of electrical relay switch 100 may be electrically coupled to a second control tap 112 of the motor 36 via a wire 168.

During a cooling mode operation with climate control system 10, the compressor 22 may be operating to circulate the refrigerant through the refrigerant circuit 20 to cool the interior space 12 as previously described (FIG. 1). In addition, when operating the climate control system 10 in the cooling mode, the thermostat 14 may energize the blower call terminal 16 so that the first control tap 116 on motor 36 is energized.

Further, when the climate control system 10 is operating the low cooling stage, the thermostat 14 may also energize the first compressor stage terminal 18 to operate the compressor 22 at the low speed, and may de-energize the second cooling stage terminal 19. As a result, the electromagnet 110 may be de-energized (due to the lack of electrical current in the wire 162) so that the electrical relay switch 100 is placed in the first position (FIG. 2) to de-couple the second control tap 112 on the motor 36 from the electrical power source 126 and to couple the second control tap 112 to the first heating terminal 52 via electrical relay switch 100 and wire 164. However, when the climate control system 10 is operating in the cooling mode to cool the interior space 12 as previously described (FIG. 1), the first heating stage terminal 52 of thermostat 14 may be de-energized. As a result, the second control tap 112 on motor 36 may be de-energized when the electrical relay switch 100 is in the first position (FIG. 2) during a cooling mode operation. Energizing the first control tap 116 and not the second control tap 112 may be configured to operate the motor 36 at a first blower speed, which may correspond with a first airflow speed for the airflow 40 via the blower 38.

However, when the climate control system 10 is to operate in the high cooling stage, the thermostat 14 may energize the second compressor stage terminal 19 and wires 162 so that the compressor 22 is operated at the high speed. In addition, the wires 162 may also energize the electromagnet 110 to place the electrical relay switch 100 to the second position (FIG. 3) to electrically couple the second control tap 112 on the motor 36 to the electrical power source 126 and thereby electrically energize the second control tap 112. During the second cooling stage operation, the blower call terminal 17 may still be energized so that the first control terminal 116 on motor 36 is also still energized. Simultaneously energizing both the first control tap 116 and second control tap 112 on motor 36 may be configured to operate the motor 36 at a second blower speed, which may correspond with a second airflow speed for the airflow 40 via the blower 38. The second blower speed and second airflow speed may be greater than the first blower speed and first airflow speed, respectively.

Thus, the electrical relay switch 100 may allow the speed of the motor 36 (and thus also the speed of the blower 38 and airflow 40) to increase in concert with the speed of the compressor 22 when operating in different cooling stages without the use of additional complex control boards or terminals outside those used to communicate the selection of the cooling stage operation to the outdoor unit 25. As a result, the electrical relay switch 100 may provide a simple solution for adjusting the speed of the airflow 40 based on the cooling stage of the refrigerant circuit 20 to provide enhanced efficiency and performance to the climate control system 10. In addition, the electrical relay switch 100 may allow a technician to select the desired speeds for different cooling stages by connecting the wires 158, 168 to the desired control taps 112, 114, 116, 118, 120. Moreover, because selective energization and de-energization of the second control tap 112 selectively operates the motor 36 at two different speeds when another control tap is energized (e.g., such as the first control tap 116 in the embodiment illustrated in FIGS. 2 and 3), the electrical relay switch 100 may facilitate multi-speeds functionality for the blower 36 via a connection to a single control tap (e.g., first control tap 116) on the motor 36.

The electrical relay switch 100 may also provide a similar adjustment in the speed of the blower 38 during different heating stage operations of the refrigerant circuit 20 when the climate control system 10 is configured as a heat pump as previously described. Specifically, during a heating mode operation of the climate control system 10 using the refrigerant circuit 20, the electrical relay switch 100 may be configured to energize the second control tap 112 on the motor 36 based on an energization of the second compressor stage terminal 19 on the thermostat 14 to increase a speed of the compressor 22 during a higher heating stage of the climate control system 10 in a similar manner to that described above for the cooling mode operation.

Additionally, the electrical relay switch 100 may also be configured to provide different airflow speeds via motor 36 with an embodiment of climate control system 10 that includes a compressor 22 configured to operate at a single speed. In these embodiments, the second compressor stage terminal 19 may not be electrically coupled to the compressor 22 (or component of the outdoor unit 25), and may simply be used to actuate the electrical relay switch 100 between the first position (FIG. 2) and the second position (FIG. 3), and thereby increase a speed of the motor 36 from the first blower speed to the second blower speed as previously described.

In addition, the electrical relay switch 100 may be configured to adjust the speed of the motor 36 during a heating mode operation using the supplemental heating unit 50. Specifically, when the climate control system 10 is operating in the heating mode using the supplemental heating unit 50, the compressor 22 may not be operating so that the second compressor stage terminal 19 may be de-energized. As a result, the electromagnet 110 may remain de-energized during a heating mode operation with supplemental heating unit 50 so that the electrical relay switch 100 may remain in the first position of FIG. 2.

During the heating mode operation, the thermostat 14 may energize the first heating stage terminal 52 to thereby operate the supplemental heating unit 50 at the low heating stage. In addition, the thermostat 14 may once again energize the blower call terminal 17 which, in turn energizes the first control tap 116 on the motor 36 as previously described. Moreover, because the electrical relay switch is in the first position (FIG. 2) as previously described, the energization of the first heating stage terminal 52 may also energize the second control tap 112 on the motor 36. Energizing the first control tap 116 and second control tap 112 may operate the motor 36 at the second blower speed previously described.

When the climate control system 10 is to operate in the high heating stage via the supplemental heating unit 50, the thermostat 14 may energize the second heating stage terminal 54 and wires 166 in addition to the first heating stage terminal 52 and wires 164 to thereby operate the supplemental heating unit 50 at the high heating stage as previously described. In addition, the wires 166 may be electrically coupled to the third control tap 118 on the motor 36 so that energization of the second heating stage terminal 54 may also energize the third control tap 118. The motor 36 may be configured such that when multiples of the control taps 114, 116, 118, 120 are energized simultaneously, the motor 36 may recognize the highest-speed control tap of the energized control taps only. Thus, energizing the first control tap 116, the second control tap 112, and third control tap 118 simultaneously may cause the motor to recognize only the combination of the second control tap 112 and third control tap 118, which may be configured to operate the motor 36 at a third blower speed. The third blower speed may be greater than the second blower speed.

Thus, the electrical relay switch 100 may also allow the speed of the motor 36 (and thus also the speed of the blower 38 and airflow 40) to increase in concert with the heating stage of the supplemental heating unit 50. As a result, the electrical relay switch 100 may provide a simple solution for adjusting the speed of the airflow 40 during both a cooling mode and heating mode operation of the climate control system 10 to provide enhanced efficiency and performance thereto.

In addition, in some embodiments, the motor 36 may be configured such that energization of the second control tap 112 without also energizing at least one of the other taps 114, 116, 118, 120 may cause the motor 36 to operate a maximum speed of the motor 36 as a failsafe to prevent damage to one or more components of the climate control system 10. The maximum blower speed may be greater than at least one of the first blower speed, second blower speed, and third blower speed previously described herein.

Specifically, during a heating mode operation using the supplemental heating unit 50, the electrical relay switch 100 may remain in the first position of FIG. 2 as previously described. As a result, operating the supplemental heating unit 50 at any heating stage may include energization of the second control tap 112. A failure to energize the blower call terminal 17 during a low heating stage, or the high heating stage terminal 54 during the high heating stage should therefore result in only the second control tap 112 being energized. Accordingly, such an energization of the second control tap 112 alone may cause motor 36 to be operated at the maximum blower speed to ensure that supplemental heating unit 50 does not overheat (which again may result in damage thereto). Moreover, if the low heating storage terminal 52 should fail to energize, then the supplemental heating unit 50 would fail to operate at all-thereby further avoiding damage thereto due to lack of sufficient airflow.

Figure 4:
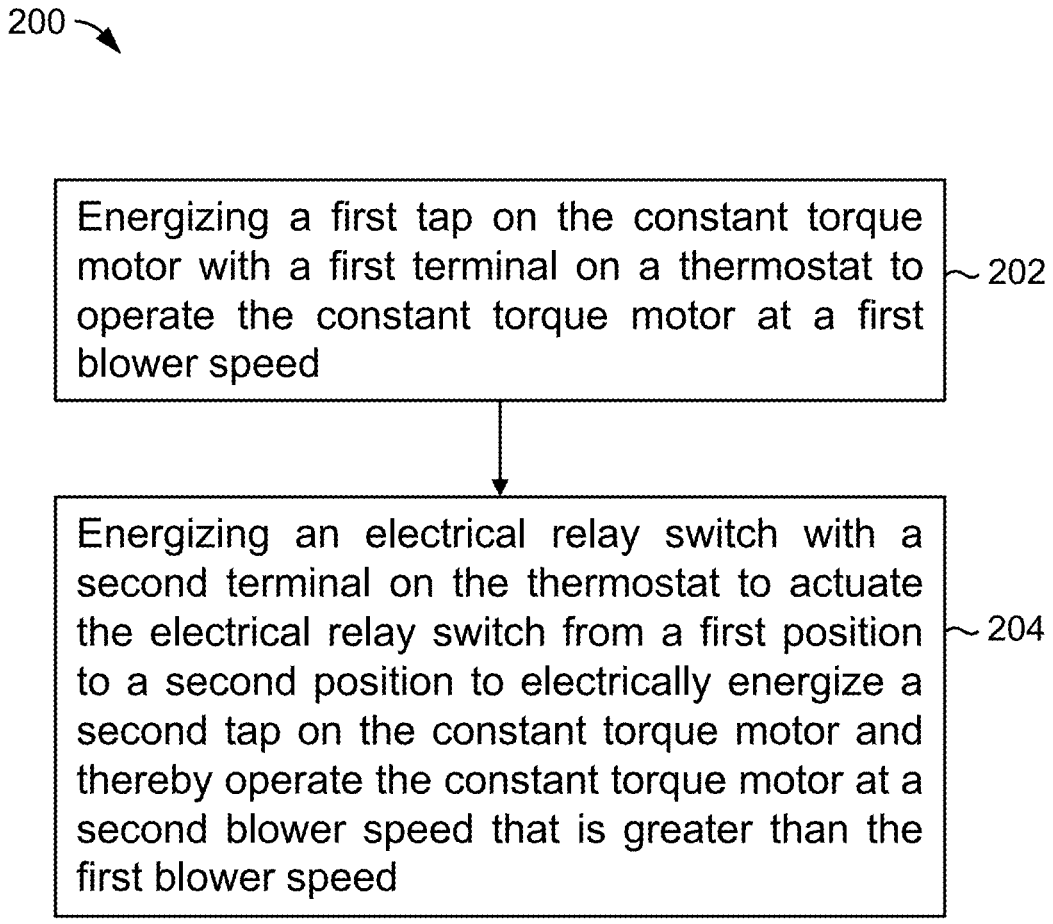
FIG. 4 is a block diagram of a method of operating a climate control system including a blower driven by a constant torque motor to generate an airflow for an indoor space according to some embodiments disclosed herein.

Referring now to FIG. 4, a method 200 of operating a climate control system including a blower driven by a constant torque motor to generate an airflow for an indoor space is shown according to some embodiments. The method 200 may be performed using embodiments of the climate control system 10 shown in FIGS. 1-3. Thus, in describing the features of method 200, continuing reference is made to FIGS. 1-3. However, it should be appreciated that embodiments of method 200 may be performed using climate control systems that are different from the embodiments of climate control system 10 described herein or shown in FIGS. 1-3 in at least some respect. Thus, reference to FIGS. 1-3 should not be interpreted as limiting all possible embodiments of the method 200 in various embodiments.

Initially, method 200 includes energizing a first tap on the constant torque motor with a first terminal on a thermostat to operate the contrast torque motor at a first blower speed at block 202. For instance, for the embodiments of climate control system 10 shown in FIGS. 1-3, the thermostat 14 may energize the blower call terminal 17 which thereby energizes the first control tap 116 on motor 36 via the wire 158. Energizing the first control tap 116 may cause the motor 36 to operate at the first blower speed as previously described. The thermostat 14 may energize the blower call terminal 17 during operation in the cooling or heating mode via the refrigerant circuit 20 and/or during operation in the heating mode via the supplemental heating unit 50 as previously described.

In addition, method 200 includes, at block 204, energizing an electrical relay switch with a second terminal on the thermostat to actuate the electrical relay switch form a first position to a second position to electrically energize a second tap on the constant torque motor to thereby operate the constant torque motor at a second blower speed that is greater than the first blower speed. In some embodiments, block 204 may be performed during performance of block 202. For instance, for the embodiments of climate control system 10 shown in FIGS. 1-3, the thermostat may energize the second compressor stage terminal 19 so as to operate the climate control system 10 in a high cooling or high heating stage using the refrigerant circuit 20 as previously described. Energizing the second stage compressor terminal 19 may also energize the electromagnet 110 of the electrical relay switch 100 so as to transition the electrical relay switch 100 from the first position (FIG. 2) to the second position (FIG. 3) and thereby electrically couple the second control tap 112 of the motor 36 to the electrical power source 126 (via transformer 130 and thermostat 14). As previously described energizing both the first control tap 116 and second control tap 112 on the motor 36 may be configured to increase a speed of the motor 36 from the first blower speed to the second blower speed.

As explained above and reiterated below, the present disclosure includes, without limitation, the following example implementations.

Clause 1: An indoor unit of a climate control system, the indoor unit comprising: a blower configured to generate an airflow; a heat exchanger that is configured to transfer heat between a refrigerant and the airflow; a constant torque motor that is configured to drive the blower, the constant torque motor including a first tap and a second tap, the first tap being configured to be electrically coupled to a first terminal of a thermostat, and the constant torque motor being configured such that: energization of the first tap and not the second tap is associated with operating the constant torque motor at a first blower speed; and energization of the first tap and the second tap is associated with operating the constant torque motor at a second blower speed that is greater than the first blower speed; and an electrical relay switch that is electrically coupled to the second tap, the electrical relay switch being configured to be electrically coupled to a second terminal of the thermostat such that energization of the second terminal is configured to actuate the electrical relay switch from (i) a first position to electrically de-energize the second tap to operate the constant torque motor at the first blower speed to (ii) a second position to electrically energize the second tap to operate the constant torque motor at the second blower speed.

Clause 2: The indoor unit of any of the clauses, further comprising: a supplemental heating unit that is configured to heat the airflow, wherein the supplemental heating unit is configured to operate at a first heating stage in which the supplemental heating unit delivers a first heating capacity to the airflow, wherein the supplemental heating unit is configured to operate at a second heating stage in which the supplemental heating unit delivers a second heating capacity to the airflow, the second heating capacity being greater than the first heating capacity, and wherein the supplemental heating unit is electrically coupled to the constant torque motor via the electrical relay switch.

Clause 3: The indoor unit of any of the clauses, wherein the electrical relay switch is configured to be electrically coupled to a third terminal of the thermostat that is associated with operation of the supplemental heating unit at the first heating stage such that when the electrical relay switch is in the first position, energization of the third terminal on the thermostat is configured to energize the second tap on the motor.

Clause 4: The indoor unit of any of the clauses, wherein the constant torque motor includes a third tap that is configured to be electrically coupled to a fourth terminal of the thermostat, the fourth terminal being associated with operation of the supplemental heating unit at the second heating stage, and wherein the constant torque motor is configured to operate at a third blower speed when the thermostat energizes the fourth terminal and the first terminal.

Clause 5: The indoor unit of any of the clauses, wherein the constant torque motor is configured to operate at a maximum blower speed when the second tap is energized via the electrical relay switch in the first position and no other tap of the constant torque motor is energized.

Clause 6: The indoor unit of any of the clauses, wherein the third blower speed is greater than the second blower speed.

Clause 7: The indoor unit of any of the clauses, wherein the electrical relay switch comprises a single pole double throw relay switch.

Clause 8: The indoor unit of any of the clauses, wherein the supplemental heating unit comprises an electrically resistive supplemental heating unit.

Clause 9: A method of operating a climate control system including a blower that is driven by a constant torque motor to generate an airflow for an indoor space, the method comprising: (a) energizing a first tap on the constant torque motor with a first terminal on a thermostat to operate the constant torque motor at a first blower speed; and (b) energizing an electrical relay switch with a second terminal on the thermostat, during (a), to actuate the electrical relay switch from a first position to a second position to electrically energize a second tap on the constant torque motor and thereby operate the constant torque motor at a second blower speed that is greater than the first blower speed, the electrical relay switch comprising a single throw double pole relay.

Clause 10: The method of any of the clauses, further comprising: (c) operating a supplemental heating unit of the climate control system at a first heating stage to deliver a first heating capacity to the airflow; and (d) energizing the second tap on the constant torque motor with a third terminal of the thermostat via the electrical relay switch in the first position during (a) and (c) to operate the constant torque motor at the second blower speed.

Clause 11: The method of any of the clauses, further comprising: (e) de-energizing the first tap on the constant torque motor; and (f) energizing the second tap on the constant torque motor via the third terminal and the electrical relay switch in the first position during (e) to operate the constant torque motor at a maximum blower speed.

Clause 12: The method of any of the clauses, further comprising: (g) operating the supplemental heating unit of the climate control system at a second heat stage to deliver a second heating capacity to the airflow, the second heating capacity being greater than the first heating capacity; and (h) energizing a third tap on the constant torque motor with a fourth terminal of the thermostat separately from the electrically relay switch during (a) and (g) to operate the constant torque motor at a third blower speed that is greater than the second blower speed.

Clause 13: A climate control system to condition an indoor space, the climate control system comprising: a blower configured to generate an airflow for the indoor space; a constant torque motor that is configured to drive the blower, the constant torque motor including a first tap and a second tap and configured such that: energization of the first tap and not the second tap is associated with operating the constant torque motor at a first blower speed; and energization of the first tap and the second tap is associated with operating the constant torque motor at a second blower speed that is greater than the first blower speed; an evaporator that is configured to transfer heat from the airflow to a refrigerant, the evaporator operable at a first cooling stage to deliver a first cooling capacity to the airflow and a second cooling stage to deliver a second cooling capacity that is greater than the first cooling capacity; a thermostat including a first terminal and a second terminal, the first terminal being associated with operation of the evaporator in the first cooling stage and the second terminal being associated with operation of the evaporator in the second cooling stage, and the first terminal being electrically coupled to the first tap on the constant torque motor; and an electrical relay switch that is electrically coupled to the second terminal such that energization of the second terminal is configured to actuate the electrical relay switch from (i) a first position to electrically de-energize the second tap to operate the constant torque motor at the first blower speed to (ii) a second position to electrically energize the second tap to operate the constant torque motor at the second blower speed.

Clause 14: The climate control system of any of the clauses, further comprising: a supplemental heating unit that is configured to heat the airflow, the supplemental heating unit being electrically coupled to a third terminal of the thermostat such that energization of the third terminal is configured to operate the supplemental heating unit at a first heating stage to deliver a first heating capacity to the airflow, wherein the electrical relay switch is also electrically coupled to the third terminal of the thermostat such that when the electrical relay switch is in the first position, energization of the third terminal is configured to energize the second tap on the constant torque motor, and wherein the constant torque motor is configured to operate at the second blower speed when: the second tap is energized via the third terminal of the thermostat and the electrical relay switch in the first position, and the first tap is energized via the first terminal of the thermostat.

Clause 15: The climate control system of any of the clauses, wherein the supplemental heating unit is also electrically coupled to a fourth terminal of the thermostat such that energization of the fourth terminal of the thermostat is configured to operate the supplemental heating unit in a second heating stage to deliver a second heating capacity to the airflow, the second heating capacity being greater than the first heating capacity, wherein a third tap on the constant torque motor is also electrically coupled to the fourth terminal of the thermostat such that energization of the fourth terminal of the thermostat is configured to energize the third tap on the constant torque motor, and wherein the constant torque motor is configured to operate at a third blower speed when: the third tap is energized via the fourth terminal of the thermostat; and the first tap is energized via the first terminal of the thermostat.

Clause 16: The climate control system of any of the clauses, wherein the constant torque motor is configured to operate at a maximum blower speed when the second tap is energized via the third terminal and the electrical relay switch in the first position and no other tap of the constant torque motor is energized.

Clause 17: The climate control system of any of the clauses, wherein the third blower speed is greater than the second blower speed.

Clause 18: The climate control system of any of the clauses, wherein the maximum blower speed is greater than the third blower speed.

Clause 19: The climate control system of any of the clauses, wherein the electrical relay switch comprises a single pole double throw relay switch.

Clause 20: The climate control system of any of the clauses, wherein the supplemental heating unit comprises an electrically resistive supplemental heating unit.

Embodiments disclosed herein include climate control systems that are configured to operate a blower at multiple speeds by use of simple wiring connections. For instance, embodiments of climate control systems described herein may include an electrical relay switch that may be used to selectively operate the blower at multiple speeds. In addition, in some embodiments, the electrical relay switch may be further coupled to a supplemental heating unit of the climate control system so that the blower may be operated in concert with the supplemental heating unit without additional switches or controllers. Therefore, through use of the embodiments disclosed herein, a climate control system may employ a multi-speed blower during both cooling and heating without also substantially increasing the costs and complexities thereof.

The preceding discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the discussion herein and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like, when used in reference to a stated value mean within a range of plus or minus 10% of the stated value.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. An indoor unit of a climate control system, the indoor unit comprising:

a blower configured to generate an airflow;

a heat exchanger that is configured to transfer heat between a refrigerant and the airflow;

a constant torque motor that is configured to drive the blower, the constant torque motor including a first tap and a second tap, the first tap being configured to be electrically coupled to a first terminal of a thermostat, and the constant torque motor being configured such that:

energization of the first tap and not the second tap is associated with operating the constant torque motor at a first blower speed; and energization of the first tap and the second tap is associated with operating the constant torque motor at a second blower speed that is greater than the first blower speed; and an electrical relay switch that is electrically coupled to the second tap, the electrical relay switch being configured to be electrically coupled to a second terminal of the thermostat such that energization of the second terminal is configured to actuate the electrical relay switch from (i) a first position to electrically de-energize the second tap to operate the constant torque motor at the first blower speed to (ii) a second position to electrically energize the second tap to operate the constant torque motor at the second blower speed.

2. The indoor unit of claim 1, further comprising:

a supplemental heating unit that is configured to heat the airflow, wherein the supplemental heating unit is configured to operate at a first heating stage in which the supplemental heating unit delivers a first heating capacity to the airflow, wherein the supplemental heating unit is configured to operate at a second heating stage in which the supplemental heating unit delivers a second heating capacity to the airflow, the second heating capacity being greater than the first heating capacity, and wherein the supplemental heating unit is electrically coupled to the constant torque motor via the electrical relay switch.

3. The indoor unit of claim 2, wherein the electrical relay switch is configured to be electrically coupled to a third terminal of the thermostat that is associated with operation of the supplemental heating unit at the first heating stage such that when the electrical relay switch is in the first position, energization of the third terminal on the thermostat is configured to energize the second tap on the motor.

4. The indoor unit of claim 3, wherein the constant torque motor includes a third tap that is configured to be electrically coupled to a fourth terminal of the thermostat, the fourth terminal being associated with operation of the supplemental heating unit at the second heating stage, and wherein the constant torque motor is configured to operate at a third blower speed when the thermostat energizes the fourth terminal and the first terminal.

5. The indoor unit of claim 4, wherein the constant torque motor is configured to operate at a maximum blower speed when the second tap is energized via the electrical relay switch in the first position and no other tap of the constant torque motor is energized.

6. The indoor unit of claim 4, wherein the third blower speed is greater than the second blower speed.

7. The indoor unit of claim 6, wherein the electrical relay switch comprises a single pole double throw relay switch.

8. The indoor unit of claim 7, wherein the supplemental heating unit comprises an electrically resistive supplemental heating unit.

9. A method of operating a climate control system including a blower that is driven by a constant torque motor to generate an airflow for an indoor space, the method comprising:

(a) energizing a first tap on the constant torque motor with a first terminal on a thermostat to operate the constant torque motor at a first blower speed; and (b) energizing an electrical relay switch with a second terminal on the thermostat, during (a), to actuate the electrical relay switch from a first position to a second position to electrically energize a second tap on the constant torque motor and thereby operate the constant torque motor at a second blower speed that is greater than the first blower speed, the electrical relay switch comprising a single throw double pole relay.

10. The method of claim 9, further comprising:

(c) operating a supplemental heating unit of the climate control system at a first heating stage to deliver a first heating capacity to the airflow; and (d) energizing the second tap on the constant torque motor with a third terminal of the thermostat via the electrical relay switch in the first position during (a) and (c) to operate the constant torque motor at the second blower speed.

11. The method of claim 10, further comprising:

(e) de-energizing the first tap on the constant torque motor; and (f) energizing the second tap on the constant torque motor via the third terminal and the electrical relay switch in the first position during (e) to operate the constant torque motor at a maximum blower speed.

12. The method of claim 10, further comprising:

(g) operating the supplemental heating unit of the climate control system at a second heat stage to deliver a second heating capacity to the airflow, the second heating capacity being greater than the first heating capacity; and (h) energizing a third tap on the constant torque motor with a fourth terminal of the thermostat separately from the electrically relay switch during (a) and (g) to operate the constant torque motor at a third blower speed that is greater than the second blower speed.

13. A climate control system to condition an indoor space, the climate control system comprising:

a blower configured to generate an airflow for the indoor space;

a constant torque motor that is configured to drive the blower, the constant torque motor including a first tap and a second tap and configured such that:

energization of the first tap and not the second tap is associated with operating the constant torque motor at a first blower speed; and energization of the first tap and the second tap is associated with operating the constant torque motor at a second blower speed that is greater than the first blower speed;

an evaporator that is configured to transfer heat from the airflow to a refrigerant, the evaporator operable at a first cooling stage to deliver a first cooling capacity to the airflow and a second cooling stage to deliver a second cooling capacity that is greater than the first cooling capacity;

a thermostat including a first terminal and a second terminal, the first terminal being associated with operation of the evaporator in the first cooling stage and the second terminal being associated with operation of the evaporator in the second cooling stage, and the first terminal being electrically coupled to the first tap on the constant torque motor; and an electrical relay switch that is electrically coupled to the second terminal such that energization of the second terminal is configured to actuate the electrical relay switch from (i) a first position to electrically de-energize the second tap to operate the constant torque motor at the first blower speed to (ii) a second position to electrically energize the second tap to operate the constant torque motor at the second blower speed.

14. The climate control system of claim 13, further comprising:

a supplemental heating unit that is configured to heat the airflow, the supplemental heating unit being electrically coupled to a third terminal of the thermostat such that energization of the third terminal is configured to operate the supplemental heating unit at a first heating stage to deliver a first heating capacity to the airflow, wherein the electrical relay switch is also electrically coupled to the third terminal of the thermostat such that when the electrical relay switch is in the first position, energization of the third terminal is configured to energize the second tap on the constant torque motor, and wherein the constant torque motor is configured to operate at the second blower speed when:

the second tap is energized via the third terminal of the thermostat and the electrical relay switch in the first position, and the first tap is energized via the first terminal of the thermostat.

15. The climate control system of claim 14, wherein the supplemental heating unit is also electrically coupled to a fourth terminal of the thermostat such that energization of the fourth terminal of the thermostat is configured to operate the supplemental heating unit in a second heating stage to deliver a second heating capacity to the airflow, the second heating capacity being greater than the first heating capacity, wherein a third tap on the constant torque motor is also electrically coupled to the fourth terminal of the thermostat such that energization of the fourth terminal of the thermostat is configured to energize the third tap on the constant torque motor, and wherein the constant torque motor is configured to operate at a third blower speed when:

the third tap is energized via the fourth terminal of the thermostat; and the first tap is energized via the first terminal of the thermostat.

16. The climate control system of claim 15, wherein the constant torque motor is configured to operate at a maximum blower speed when the second tap is energized via the third terminal and the electrical relay switch in the first position and no other tap of the constant torque motor is energized.

17. The climate control system of claim 16, wherein the third blower speed is greater than the second blower speed.

18. The climate control system of claim 17, wherein the maximum blower speed is greater than the third blower speed.

19. The climate control system of claim 18, wherein the electrical relay switch comprises a single pole double throw relay switch.

20. The climate control system of claim 19, wherein the supplemental heating unit comprises an electrically resistive supplemental heating unit.

* * * * *